US010709257B2

(12) United States Patent
Yao et al.

(10) Patent No.: US 10,709,257 B2
(45) Date of Patent: Jul. 14, 2020

(54) MULTI-FUNCTION MATTRESS WITH MAGLEV SUSPENSION AND ELASTIC CUSHION MODULE

(71) Applicants: Kang Yao, Delray Beach, FL (US); Nan An, Boca Raton, FL (US)

(72) Inventors: Kang Yao, Delray Beach, FL (US); Nan An, Boca Raton, FL (US)

(73) Assignee: Kang Yao, Delray Beach, FL (US)

( * ) Notice: Subject to any disclaimer, the term of this patent is extended or adjusted under 35 U.S.C. 154(b) by 242 days.

(21) Appl. No.: 16/047,555

(22) Filed: Jul. 27, 2018

(65) Prior Publication Data

US 2020/0029706 A1 Jan. 30, 2020

(51) Int. Cl.

| | |
|---|---|
| ***A47C 31/00*** | (2006.01) |
| ***A61H 15/00*** | (2006.01) |
| ***A47C 31/12*** | (2006.01) |
| ***A47C 27/15*** | (2006.01) |

(52) U.S. Cl.

CPC ..... *A47C 31/003* (2013.01); *A47C 27/15* (2013.01); *A47C 31/123* (2013.01); *A61H 15/0078* (2013.01)

(58) Field of Classification Search

CPC ..... A47C 31/00

USPC ..... 5/693, 690, 903

See application file for complete search history.

(56) References Cited

U.S. PATENT DOCUMENTS

| | | | | |
|---|---|---|---|---|
| 3,604,027 A * | 9/1971 | Konno | A47C 23/043 | 5/697 |
| 5,103,513 A * | 4/1992 | King | A47C 7/14 | 5/118 |
| 5,168,588 A * | 12/1992 | Chan | A47C 31/003 | 5/693 |
| 2004/0085168 A1* | 5/2004 | Martin | H01F 7/0278 | 335/207 |

* cited by examiner

*Primary Examiner* — Fredrick C Conley

(57) ABSTRACT

The present invention relates to a multi-function mattress composed of MagLev suspension, stretched net surface and adjustable underneath elastic cushion modules for optimized body contour-fitting and head-shoulder-neck massage by the motorized roller. This mattress design provides a unique solution to achieve the best body contour-fitting with a simple structure. The MagLev suspension technology helps generate the best support for the entire body during the sleep. It also provides comfort and relaxation that is associated with the sleep-cool technique, which is achieved through the underneath hollow structure. This mattress can be made at efficient cost to perform multi-function. The energy-efficient design also reduces its impact on the environment.

12 Claims, 9 Drawing Sheets

$L_1+L_2=L$ $L_1+L_2=L$

MULTI-FUNCTION MATTRESS WITH MAGLEV SUSPENSION AND ELASTIC CUSHION MODULE

BACKGROUND OF THE INVENTION

Sleeping is an important part of our lives accounting for about one third of our life time. A comfortable body contour-fitting mattress is important for everyone. There have been many types of mattress using different technology, yet few can achieve the great function through simple design at an affordable cost. Our mattress with MagLev suspension, elastic cushion module and simple stretched net surface provides a new approach in solving this daunting task. Our invention makes it feasible for consumer to enjoy the MagLev suspension during sleep. It features a self-adjusting mattress via the MagLev suspension and fine tuning of the surface tension by the elastic cushion modules. This helps generate the best support for the entire body. It also provides comfort and relaxation that is associated with the sleep-cool technique, which is achieved via the simple yet efficient hollow structure design. The user can also enjoy the gentle magnetic massage associated with the magnetic field of the MagLev module. There is also a motorized roller installed near the head module which helps massage the important head-neck-shoulder area. It is easy to operate and maintain and can be made at an affordable cost.

Magnet-related mattresses are disclosed in certain prior patents.

U.S. Patent No.20040085168A1 shows a device that utilizes repulsive forces of opposing magnetic fields. The apparatus includes first and second frame members having a pluralities of magnets and spring coils. The combine force of spring coil and magnetic repulsive forces support the human body on top of the apparatus. The first and second frame members interact such that they maintain a substantially static lateral position relative to each other despite the opposing magnetic fields. This prior art started a new trend for the sectional bed support according to human body weight distribution.

U.S. Patent No.20050115003A1 shows a mattress for supporting a reclining body with low body pressure and in alignment. The mattress, extends in a lateral direction from side to side and extends in a longitudinal direction from a mattress head to a mattress foot where the mattress includes a head part, a shoulder part, a waist part, a hip part and a leg part. The reclining body has a displacement profile that causes the mattress to undergo differing vertical displacements when supporting the reclining body. This art resembles the natural body contour and illustrates the importance of the sectional body contour-fitting for the mattress design. It has more details in depicting the body contour section compared to the prior art.

U.S. Patent No.20170325596A1 shows a foam mattress having an adjustable mattress core for adjusting and customizing its firmness. The foam mattress has a foam base having an upper surface defining a top recess and a plurality of foam inserts each configured to be disposed and assembled into the top recess to fill the top recess and form the mattress core with a continued upper surface of the mattress. This technology is similar to the prior arts and made it relative easier to manufacture. Yet, its Lego-style combination of various elastic cushion modules support made it tedious to reach the best fitting plan for the user's body contour.

Our innovative mattress is self-adjusting using the sleeper's body weight to interact with the MagLev suspension modules and the stretched net. Further fine adjustment can be made by adjusting the underneath elastic cushion modules, which enables the best fitting of the stretched net to the body contour. With our special hollow structure design, consumer can enjoy the sleep-cool experience. Our mattress with MagLev suspension and adjustable underneath elastic module for optimized body contour-fitting is compact in design and easy to use. Thanks to the simplicity in design and manufacturing, it will provide multi-function luxury to everyday consumer at great cost-efficiency.

SUMMARY OF THE INVENTION

The present invention relates to a new kind of multi-function mattress with MagLev suspension and adjustable underneath elastic cushion module for optimized body fitting. With the key components of self-adjustable MagLev modules and elastic magnetic positioned cushion modules. The mattress with MagLev suspension and elastic cushion modules comprises:

(a) a mattress frame;

(b) a continuous stretched net forming both upper and bottom surfaces;

(c) a plurality of adjustable suspension modules in the head, middle and foot section;

(d) a plurality of adjustable elastic cushion modules;

(e) a steel track inside the mattress frame;

(f) a shaft mounted near the edge of the mattress frame;

(g) a roller to turn the shaft to adjust the tension of the net;

(h) a motorized roller installed near the head module area that can move within the specified range to massage the head-shoulder-neck area of the body.

The mattress comprises pairs of permanent MagLev modules contained by mounting plates to form the basis of the MagLev Mattress as magnetic suspension for body support. In FIG. 1, the MagLev module for mattress suspension contains several pairs of magnets coupled with the MTL (Magnetic tension locker) guide rod. For a further understanding of the scope of the present invention using the MagLev suspension module, reference can be made to U.S. patent application Ser. No. 15/892,838, entitled "MagLev Module with MTL Control System In Furniture and Ice-breaking Vessel" which was filed on Feb. 9, 2018 and pending. The MagLev module works on the magnetic repulsion force that consequently supports the body weight laid over the mattress surface. The module is adjustable and interchangeable with other type of suspension module of the same dimension, such as the hydraulic and spring activated module. The module is ranked by its loading capacity. Each set of module supports the weight from 80 lbs to 260 lbs. To achieve the comfort of the best contour-fitting, consumer can fine tune the tension of the stretched net, which is done by turning the shaft roller. The shaft connects the top and bottom net and is mounted near the end of the mattress frame. The net can be made of metal wire, fabric or palm fiber as long as it is strong enough to support the body weight and lasts the duty cycle of the mattress. The Young's modulus of the net is in the range of 29 GPa to 198 GPa. The MagLev modules provide the majority of the mattress support while the adjustable elastic cushion modules and the tension-tunable net provide the rest of the support needed to best fit the body contour. The MagLev module in the head section is adjustable in the mounting position inside the adjustment slot. It is designed to best fit the consumer's head-neck contour. The stretched net is connected through the roller shaft and it constrains the elastic cushion modules between the upper and bottom surfaces. The magnetically positioned elastic cushion modules are adjustable in position to tune for the area tension of the net hence provide the best support for different areas of the body. The adjustable elastic cushion modules can be hollow elastic cushion module or other types of elastic cushion as long as the replacement cushion module is in the same dimension. In FIG. 2, a detailed layered structure of mattress is illustrated. The top layer is a soft pad, followed by the layer of stretched net forming both upper and bottom surfaces. Inside the nets are the elastic cushion modules. The MagLev modules are positioned in strategic positions of head, middle and foot section of the mattress and fastened to the mounting plates inside the net. Both sides of the mattress can be used as the sleeping surface and each side has different firmness and comfort which differs from the traditional mattress. The net together with the MagLev modules and the elastic cushion modules create an unblocked air ventilation path inside the mattress offering an excellent sleep-cool experience which also prevents mold and germ from growing inside. The magnetism of the MagLev modules reinforces the germ-free environment. In FIG. 3, the detailed structure of a mattress with MagLev suspension is illustrated. As shown in FIG. 3 and FIG. 6*a*, the motorized roller travels from head to neck area along the spinal curve. This special roller is movable inside the roller track. It is designed to massage the body around the head-neck-shoulder area and help relax the person into a sound sleep. The roller is driven by a small motor powered by a rechargeable lithium-ion battery. The top and bottom net goes through a shaft which is mounted near the end of the mattress frame. The shaft is turned by the roller to adjust the tension of the net.

In FIG. 4*a*, $H_d$, $H_m$ and $H_f$ are marked as the compressed height of head, middle and foot MagLev modules. The compressed height Hd and Hf are adjustable to form a tilt or inversion for the mattress on both upper body and lower body section. The difference of compressed height $H_1$ is in the range of 0 to 18 mm, the compressed difference of compressed height $H_2$ is in the range of 0 to 20 mm. Consequently, the micro-tilt angle of upper body $\beta_1$ is in the range of 0° to 1°. The micro-tilt angle of the lower body $\beta_2$ is in the range of 0° to 1.1°. As shown in FIG. 4*b*, the maximum height difference between head and middle section $H_1$ is 18 mm, which can generate the micro-tilt angle of 1° for the up body. The maximum height difference between middle and foot section $H_2$ is 20 mm, which can generate the micro-tilt angle of 1.1° for the lower body. L is the length of the mattress which is about 2000 mm. $L_1$ is equal to $L_2$ in most cases.

Micro-tilt angle is derived by the following formula, $$\text{Micro-tilt angle}=\tan^{-1}(\text{Height difference/length})$$

$$H_1=H_d-H_m$$

$$H_2=H_f-H_m$$

$$L=L_1+L_2$$

$$\beta_1=\tan^{-1}(H_1/L_1)$$

$$\beta_2=\tan^{-1}(H_2/L_2)$$

When the foot module is higher than the middle module and the middle module is higher than the head module, a micro-inversion angle $\alpha$ is established, where $$\alpha=\tan^{-1}(H_3/L)$$

According to relative health study, there are many benefits through body inversion. Its benefit is so great even the European Space Agency (ESA) carried some experiments with the inversion-related bed-rest studies. According to the ESA experiment, mild head-down tilt of −7° reproduces to a fair extent the fluid redistribution observed in microgravity that is to occur in around-the-earth orbit. Human body is influenced by the gravity dependent circulation control mechanisms. Any posture change in the human body causes it to quickly adjust the systemic blood pressure in order to maintain an optimal blood supply of oxygen and nutrients to all areas of the body and in particular to the spinal area. Hence the posture change via inversion helps take pressure off the person's back muscles and spine, consequently reducing the back pain. The following is the main benefit of body inversion:

(1) helps position the user's herniated disc relieving the back and neck pain;

(2) decompresses spinal discs and relieves compression fatigue of the spinal discs;

(3) improves the blood circulation;

(4) helps posture correction.

The benefits are great yet few people can practice the up-right inversion due to the risk of heart attack and brain stroke. So we adopt the technology of micro-inversion during the sleep and design the unique function that is available with our innovative mattress. Compared with the intense up-right inversion and even the mild-inversion tested by ESA, the micro-inversion generated by our mattress is much safer and can produce a long-lasting benefit to human body. The micro-inversion with our mattress can be achieved by tuning the preset gap of each MagLev module to an extent that the foot module is higher than the middle module and the middle module is higher than the head module. As shown in FIG. 4*c*, the micro-inversion angle $\alpha$ ranges between 0° and 0.6°. It is adjustable to custom fit each individual. The MTL guide rod of the MagLev module can be adjusted to achieve the required height of each MagLev module. Normally, the MagLev module in the mid-section of the mattress has the largest compression since it takes most of the body weight. The compression in the head module is similar to the foot module though the foot module is slightly higher in position. In the case of micro-inversion, the difference between foot and head module with regard to the bed length decides the micro-tilt angle $\beta$. $H_d$ and Hf are both adjustable to custom-fit each person's sleeping habit with regard to the delicate head and foot micro-tilt angle. This satisfies each person's sleeping habit bringing a better blood circulation in the brain and spinal area. FIG. 5 shows a perspective view of mattress with MagLev suspension modules and adjustable elastic cushion modules. Also shown in this figure, the stretched net's tension is adjustable by rotating the shaft roller mounted near the end of the mattress. FIG. 6*a* shows a side view of mattress with MagLev suspension modules and adjustable elastic cushion modules. The position of the head module varies along the adjustment slot in the head area. Thus, it best fits each person's head-neck contour to provide the best support for this sensitive area. FIG. 6*b* shows a sectional view of mattress with focus on the magnetic positioning of adjustable elastic cushion modules. Each elastic cushion module is magnetically positioned onto the steel track inside the mattress frame.

REFERENCE

1. US20040085168A1, Jun. 3, 2002-May 6, 2004. Michael Martin. Apparatus for maintaining magnets in opposing relationship, and support apparatus that utilizes same.

2. US20050115003A1, Jun. 1, 2002-Jun. 2, 2005. Lovejoy David E. Internal contour foam mattress.
3. US20170325596A1, May 13, 2016-Nov. 16, 2017. Philip Alan Torbet, Earl Takefman. Foam mattress having an adjustable mattress core for adjusting and customizing its firmness, assembling method and kit thereof.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in each drawing. In the drawings.

Figure 1:
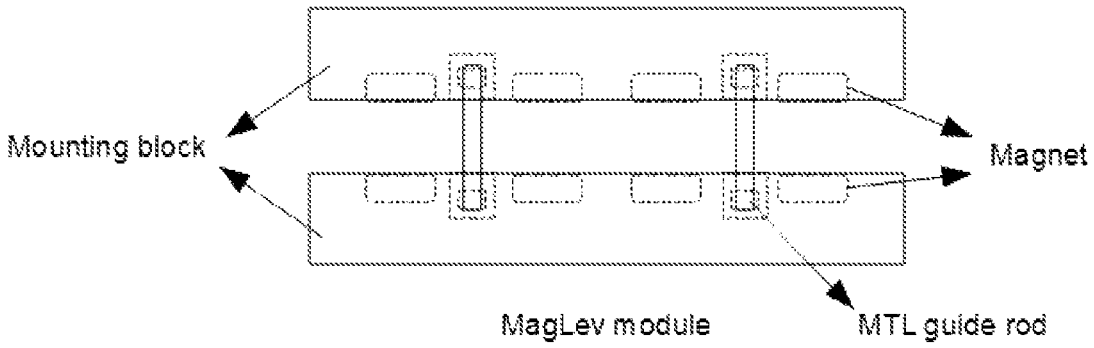
FIG. 1 shows a perspective view of structure of a MagLev module consisting of multiple pairs of magnets.
Figure 2:
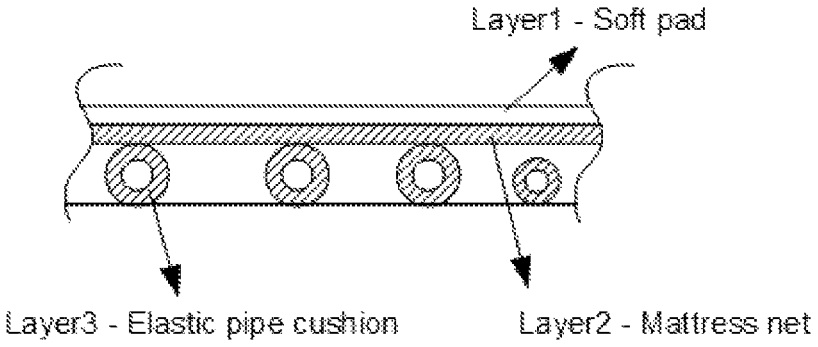
FIG. 2 shows a perspective view of a portion of the mattress in layered structure.
Figure 3:
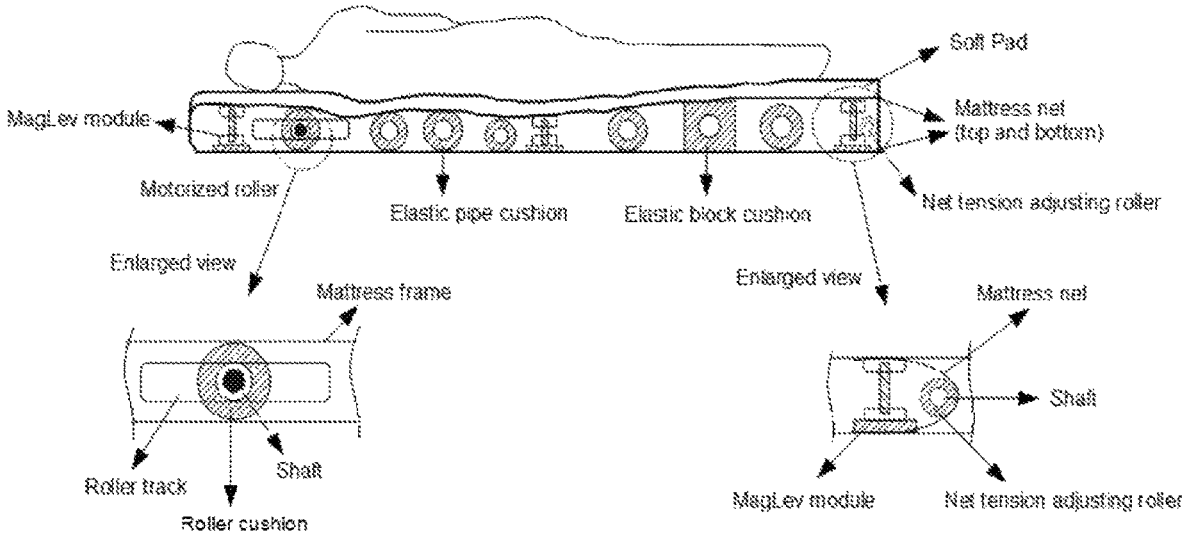
FIG. 3 shows a schematic view of a person's contour-fitting onto the mattress with MagLev suspension modules, elastic cushion modules and a motorized roller.
Figure 4A:
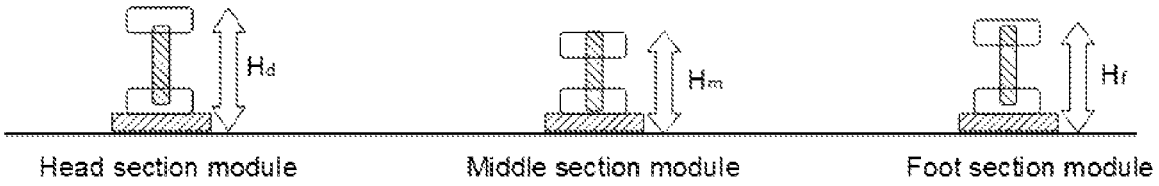
FIG. 4*a* shows a schematic view illustration the compression of head, middle and foot MagLev modules.
Figure 4B:
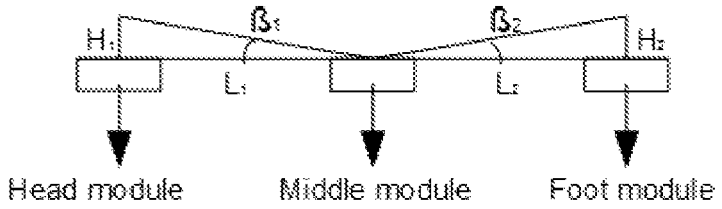
FIG. 4*b* shows a schematic view illustrating the micro-tilt angles of head, middle and foot section.
Figure 4C:
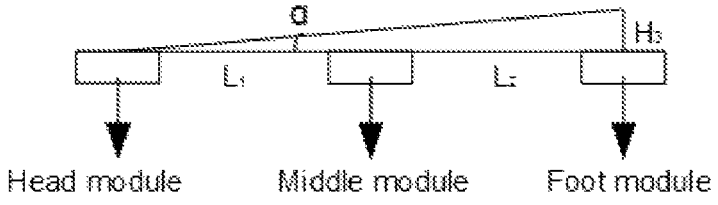
FIG. 4*c* shows a schematic view illustrating the micro-inversion angle of mattress.
Figure 5:
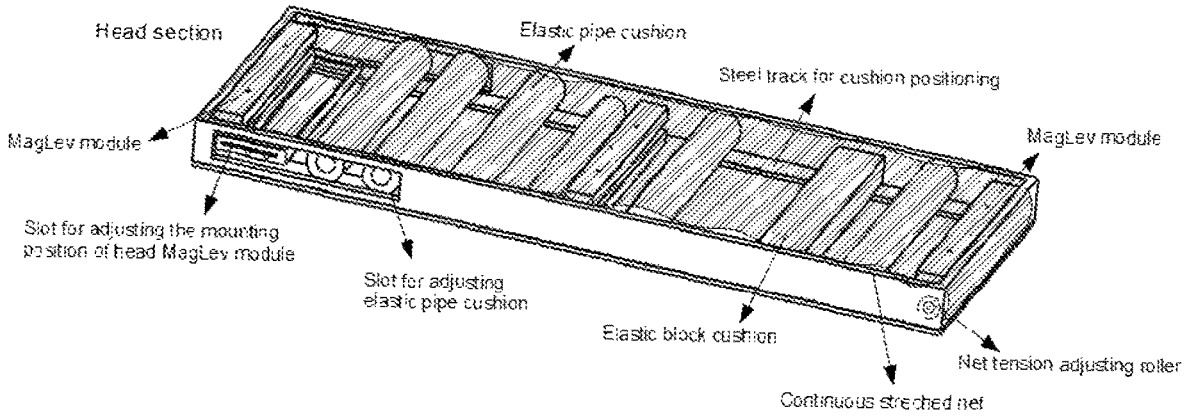
FIG. 5 shows a perspective view of mattress with MagLev suspension modules and elastic cushion modules.
Figure 6A:
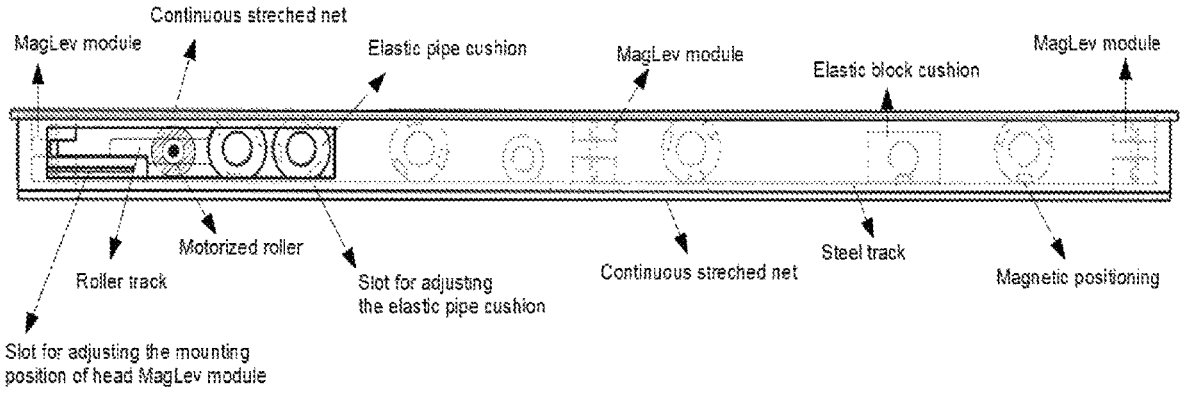
FIG. 6*a* shows a side view of mattress with MagLev suspension modules and elastic cushion modules.
Figure 6B:
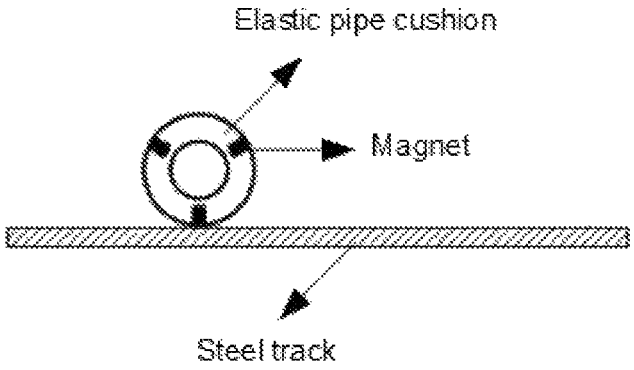
FIG. 6*b* shows a sectional view of mattress with focus on the magnetic positioning of the adjustable elastic cushion modules.

What is claimed:

1. A multi-function mattress, comprising:

a. a mattress frame;

b. a continuous stretched net forming both the top and bottom surfaces;

c. a plurality of suspension modules mounted in the head, middle and foot section;

d. a plurality of elastic cushion modules;

e. a steel track inside the mattress frame;

f. a shaft of the net mounted near the edge of the mattress frame;

g. a roller to turn the shaft of the net;

h. a motorized roller installed near the head module area, wherein the suspension modules are mounted under the stretched net and the elastic cushion modules are positioned inside the net.

2. The waitress of claim 1, wherein the suspension modules are the MagLev modules.

3. The mattress of claim 2, wherein the MagLev modules can be replaced by other types of suspension modules of the same dimension.

4. The mattress of claim 1, wherein each set of the suspension module can support the weight from 80 lbs to 260 lbs.

5. The mattress of claim 1, wherein the head suspension module is adjustable in its mounting position inside the adjustment slot.

6. The mattress of claim 1, wherein each suspension module is adjustable in its preset height position.

7. The mattress of claim 1, wherein the head, middle and foot suspension modules are adjustable in the preset height to form a micro-tilt or micro-inversion angle.

8. The mattress of claim 7, wherein the micro-tilt angle ranges from 0° to 1.1°.

9. The mattress of claim 7, wherein the micro-inversion angle ranges from 0° to 0.6°.

10. The mattress of claim 1, wherein the tension of the stretched net is adjustable by turning the roller of the shaft.

11. The mattress of claim 1, wherein the position of each elastic cushion module is adjusted magnetically along the steel track inside the mattress frame.

12. The mattress of claim 1, wherein the motorized roller moves within the roller track to massage the head-shoulder-neck area.

* * * * *